US006530378B1

(12) United States Patent
Piatetsky

(10) Patent No.: US 6,530,378 B1
(45) Date of Patent: Mar. 11, 2003

(54) LIQUID-RESERVOIR HAIRBRUSH SYSTEM

(76) Inventor: Andrey Piatetsky, 5702 Rhea Ave., Tarzana, CA (US) 91356

( * ) Notice: Subject to any disclaimer, the term of this patent is extended or adjusted under 35 U.S.C. 154(b) by 40 days.

(21) Appl. No.: 09/589,932

(22) Filed: Jun. 7, 2000

Related U.S. Application Data

(63) Continuation-in-part of application No. 09/510,210, filed on Feb. 22, 2000, now Pat. No. 6,158,442.

(51) Int. Cl.[7] ..... A45D 24/22
(52) U.S. Cl. ..... 132/115
(58) Field of Search ..... 132/108, 109, 132/110, 111, 112, 113, 114, 115, 120, 147, 148; 401/268, 274, 282, 283, 286, 287; 15/205.2

(56) References Cited

U.S. PATENT DOCUMENTS

| | | | | | |
|---|---|---|---|---|---|
| 1,263,693 | A | * | 4/1918 | Mathews | 132/114 |
| 1,462,400 | A | * | 7/1923 | warren | 132/113 |
| 2,101,132 | A | * | 12/1937 | Daly et al. | 132/112 |
| 3,101,086 | A | | 8/1963 | Di Vito | |
| 3,203,025 | A | * | 8/1965 | Schreur | 401/283 |
| 3,721,250 | A | | 3/1973 | Walter et al. | |
| 3,964,501 | A | | 6/1976 | Matchett | |
| 4,055,195 | A | | 10/1977 | Moses | |
| 4,585,018 | A | * | 4/1986 | O'Connor | 132/120 |
| 4,688,959 | A | * | 8/1987 | Snedeker et al. | 401/283 |
| 4,867,183 | A | * | 9/1989 | Busch et al. | 132/110 |
| 4,913,172 | A | * | 4/1990 | Chou | 132/118 |
| 5,154,193 | A | * | 10/1992 | Busch et al. | 132/110 |
| 5,927,290 | A | | 7/1999 | Thiruppathi | |
| 5,964,226 | A | * | 10/1999 | Sobel | 132/108 |

* cited by examiner

*Primary Examiner*—Jeffrey A. Smith
*Assistant Examiner*—Eduardo C. Robert

(57) ABSTRACT

A liquid-reservoir hairbrush that is capable of evenly dispersing water-based solutions and other thin and non-viscous liquids over the user's scalp and/or through the user's hair during routine hair brushing. Absorbent filler unit(s) are placed into a chamber of the hairbrush body and absorbent feed rods are placed into bores of the hairbrush bristles. Liquid from the absorbent filler unit(s) is supplied to the absorbent feed rods. The hairbrush can be provided with three different types of liquid outlets (viz., nozzles). The absorbent feed rods interconnects the absorbent filler unit(s) and the nozzles located at the hairbrush bristles. The chamber of the hairbrush body can be divided into multiple, hermetically isolated sections. The hairbrush body can have an optional filler inlet and can come with an optional liquid refilling unit which can hold a predetermine volume of the liquid.

9 Claims, 13 Drawing Sheets

LIQUID-RESERVOIR HAIRBRUSH SYSTEM

CROSS-REFERENCE TO RELATED APPLICATIONS

This is a continuation-in-part of U.S. patent application Ser. No. 09/510,210, filed Feb. 22, 2000, now U.S. Pat. No. 6,158,442 issued Dec. 12, 2000.

FIELD OF THE INVENTION

The present invention relates to the liquid-reservoir hairbrushes particularly well-designed for dispersing low viscosity water-based solutions and other thin and non-viscous liquids over the user's scalp and through the hair.

BACKGROUND OF THE INVENTION

Liquid-reservoir hairbrushes and combs have been available for years. In addition to combing and brushing, these devices allow a user to distribute water and oil-based solutions over the user's scalp and/or through hair. In some of these devices, liquid outlets (viz., nozzles) are mounted at distal ends of teeth or bristles. In other devices, the nozzles are located near proximal ends of the teeth or bristles (usually between them) or at a body of the hair device. However, these prior art devices have a variety of shortcomings.

For example, if the user wants to disperse the liquid only over the scalp, and the nozzle(s) are located at a bristle area of the body of the brush (e.g. U.S. Pat. No. 5,927,290 to Thiruppathi) or between the comb teeth (e.g. U.S. Pat. No. 3,964,501 to Matchett), the liquid dispensed from the nozzle initially deposits on the user's hair and wets the hair and only thereafter contacts the user's scalp. This can makes the user's hair excessively wet and uncomfortable. Even more, although the above hair devices allow the user to distribute water-based and other thin and non-viscous liquids through the hair, none of them disperse the liquid evenly. The main reason why the above devices are not able to disperse the liquids evenly through the hair is because it is extremely difficult to control a direct liquid flow through any type of nozzle.

Moreover, because a diameter of the nozzle is much smaller than a size of a liquid reservoir, different types of pumps are used to force the liquid flow through the nozzle. Accordingly, a person using this type of device has to adjust the liquid flow dispensed through the nozzle by operating different types of control mechanisms (e.g. U.S. Pat. No. 3,721,250 to Walter and U.S. Pat. No. 5,927,290 to Thiruppathi). Since the user usually has to perform the above procedure during hair brushing or combing, the prior art liquid-reservoir hairbrushes and combs with pumps are relatively complicated to operate.

Furthermore, there are other problems associated with the dispersion of water-based solutions and other thin and non-viscous liquids over the user's scalp for the devices with pumps. If the nozzles are mounted within the ends of the brush bristles or comb teeth (e.g. U.S. Pat. No. 3,101,086 to Di Vito), it would appear to be troublesome to control the liquid flow through the nozzles. Since most of the above devices have open-end teeth or bristles, the liquid will come out from the nozzles whether or not there is a contact with the user's scalp. Because all brush bristles or comb teeth cannot entirely contact the user's scalp simultaneously, the excessive liquid disperses between the user's hair and makes them wet. Others have attempted to devise ways to work around this problem. For example, U.S. Pat. No. 4,055,195 to Moses discloses a fluid-reservoir hair comb with roller balls mounted within the end of each comb tooth. Although the roller ball installed within the nozzle can partially control a high viscosity liquid flow of the oil-based solutions dispensed from the particular nozzle, the Moses construction is absolutely not acceptable for the low viscosity water-based solutions and other thin and non-viscous liquids. A well-known effect (previously described for ballpoint pens) of natural outflow of liquid through a gap between the roller ball and an internal wall of the roller ball seat, a so-called direct-flow phenomenon, in which air flows in through the gap to allow the liquid to flow out from the liquid reservoir, is liable to take place. Even more, there are another two potential problems for the users of the Moses device. First, the Moses reference notes that the roller ball installed within the nozzle of the comb tooth can release the liquid only upon moving contact of the roller ball with the user's scalp. Since, the human head is curved, just a few comb teeth usually contact the user's scalp with each pass of the comb through the person's hair. Therefore, it is very likely that the user of the Moses device will not be able to evenly dispense a sufficient amount of the liquid over the scalp during routine hair combing. Second, because of the high viscosity of the oil-based solutions, the person using the Moses comb has to apply an additional abnormal pressure to the comb to be able move the roller balls inside of the nozzles while combing.

There are certain cases where a user will desire to distribute a liquid evenly through his or her hair, for example, for styling purposes. There may be other situations where a user would like to be able to disperse at the same time one liquid only over the scalp (e.g. a medicated solution), and another liquid evenly through the hair (e.g. a styling solution). None of the prior art devices allow the person to do either of these effectively. Accordingly, there is a need for a liquid-reservoir hair device that is capable of evenly dispersing water-based solutions and other thin and non-viscous liquids through the user's hair and/or over the scalp during routine hair combing or brushing.

BRIEF DESCRIPTION OF THE INVENTION

It is a first object of the invention to provide a liquid-reservoir hairbrush that is capable of dispersing water-based solutions and other thin and non-viscous liquids over the user's scalp during routine hair combing or brushing.

The first object is achieved by locating at least one absorbent filler unit (viz., liquid absorbent) in a chamber of the hairbrush body and absorbent feed rods in bores of the hairbrush bristles. The hairbrush bristles are preferably mounted to a flexible base and the absorbent filler unit(s) are preferably made from a sufficiently spongy and/or springy material. The absorbent filler unit(s) are placed into the chamber of the hairbrush body and covered by the flexible base. Liquid outlets (viz., nozzles) are mounted at distal ends of the hairbrush bristles and have a roller ball liquid distribution mechanism, in which roller balls are rotatably mounted within each nozzle to disperse the liquid over the user's scalp only during rolling contact of the roller ball with the user's scalp. The absorbent feed rods interconnect the absorbent filler unit(s) and the roller balls, and the liquid from the absorbent filler unit(s) is supplied to the roller balls, by means of the liquid passing through the absorbent feed rods to feed a surface of each roller ball. When the user brushes his or her hair, the hairbrush bristles push on the flexible base and pressurize the absorbent filler unit(s). This pressure helps to move the liquid from the absorbent filler unit(s) down to the absorbent feed rods. The hairbrush body can have an absorbent filler divider which separates the chamber of the hairbrush body into multiple, hermetically isolated sections, and multiple absorbent filler units can be placed into these sections. A purpose of the separation is to keep the hairbrush in an overall workable condition, even if some of the nozzles and/or the hairbrush bristles leak and the liquid starts to drain or vaporize from the absorbent filler unit(s). The hairbrush can be provided with a removable bristle lid to keep the hairbrush bristles enclosed when the hairbrush is not in use, and to prevent the roller balls from drying out. A body of the hairbrush will preferably have a filler inlet, so that the user can refill the absorbent filler unit(s) with the liquid with or without an optional liquid refilling unit which can hold a predetermine volume of the liquid.

It is another object of the invention to provide a hairbrush with an alternative type of bristles, wherein instead of having the roller balls mounted at the distal ends of the hairbrush bristles, a portion of an absorbent feed rod extends outwardly beyond a distal end of the hairbrush bristle to be able to contact with the user's scalp during brushing. Liquid from the absorbent feed rods will disperse over the user's scalp upon contact of the distal ends of the absorbent feed rods with the scalp during brushing. This type of construction may provide a softer feeling brush for the users with a sensitive scalp.

It is further object of the invention to provide a hairbrush with bristles having side nozzles at sidewalls of the bristles. The absorbent feed rods extend outwardly beyond the sidewalls of the bristles and can contact the user's hair during brushing. The above type of construction of the hairbrush bristles can be very useful to evenly disperse different type of liquids through the user's hair during brushing.

BRIEF DESCRIPTION OF THE DRAWINGS

The invention is set forth in greater detail, with reference to the drawings, but is not so limited.

DETAILED DESCRIPTION OF THE INVENTION

Figure 1:
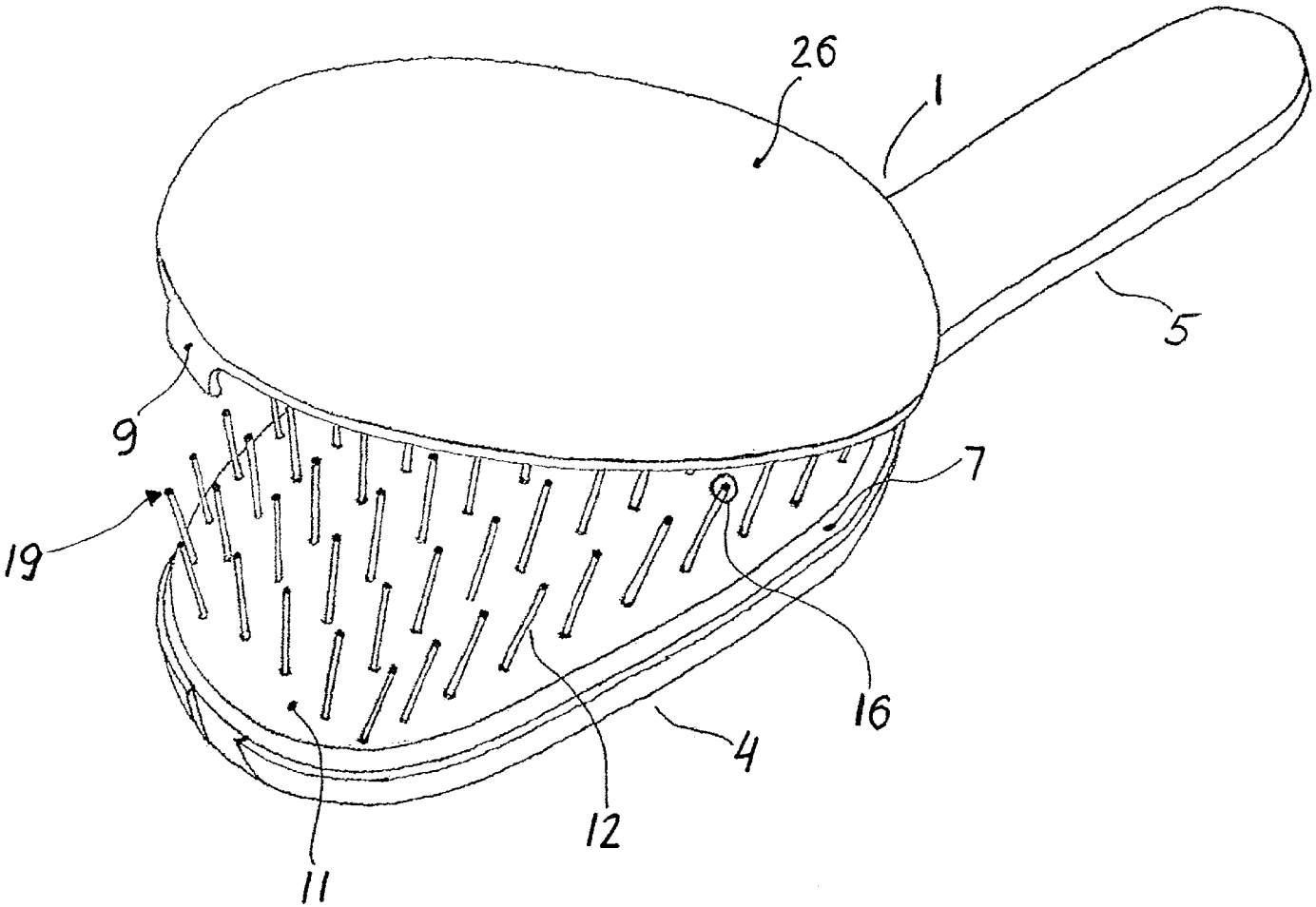
FIG. 1 is a perspective view of a first embodiment of the hairbrush in accordance with the invention. A bristle lid is partially open and a bristle area is shown.
Figure 2:
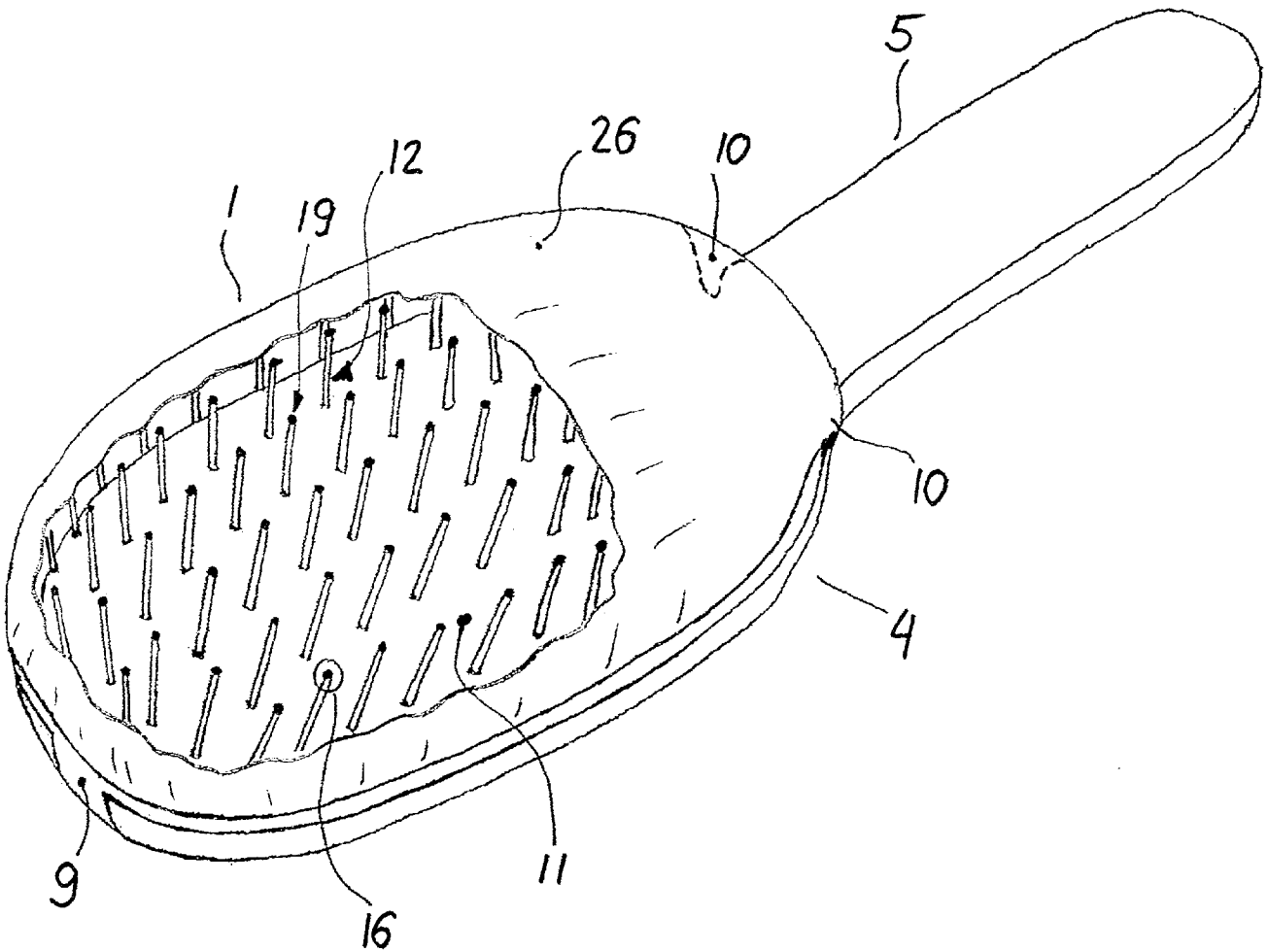
FIG. 2 is a perspective view of the hairbrush of FIG. 1 with the bristle lid closed and partially exposed to show the bristle area.
Figure 3:
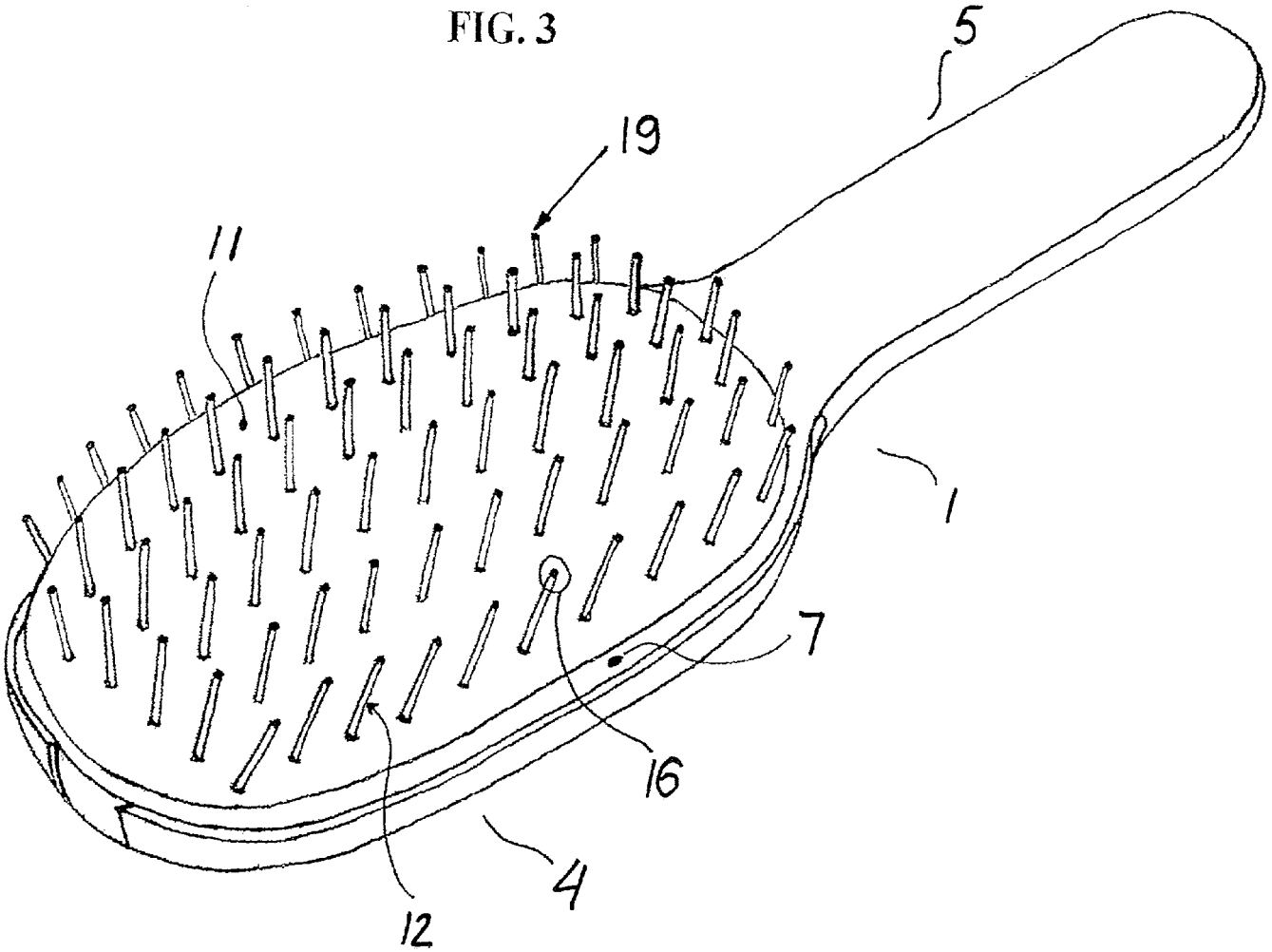
FIG. 3 is a perspective view of the hairbrush of FIG. 1 shown without the bristle lid.

The major goal of the present invention is to provide a liquid-reservoir hairbrush that will allow a user to conveniently and evenly disperse water-based solutions and other thin and non-viscous liquids over the scalp and/or through the hair during routine hair combing or brushing.

One great advantage of a hairbrush or comb with liquid outlets (viz., nozzles) located at distal ends of comb teeth or hairbrush bristles and having a roller ball liquid distribution mechanism is that the liquid from each particular nozzle will be released only upon moving contact of the roller ball mounted within that nozzle with the user's scalp.

To prevent a natural outflow of a liquid through the roller ball nozzles mounted at the distal ends of the hairbrush bristles, and to transport the liquid from the liquid reservoir down to the roller ball nozzles, for all embodiments of the hairbrush of the invention absorbent filler unit(s) will be placed into the hairbrush's liquid reservoir, and absorbent feed rods will be placed into bores of the hairbrush bristles. With respect to the above described design, there are two main reasons why a hairbrush construction is more preferable than a comb construction for efficiently dispersing of the liquid over the user's scalp from the roller ball nozzles. First, usually just a few comb teeth can contact the user's scalp with each pass of the comb through the person's hair. Thus, it will be very likely, that if the roller ball nozzles are mounted at the ends of the comb teeth, the user of this type of comb will not be able to evenly disperse a sufficient amount of the liquid over the scalp during typical hair combing. The hairbrush construction will have a greater number of bristles in contact with the user's scalp at any given time. Second, the hairbrush construction permits the bristles to be mounted to a base that can be formed from a flexible material. When pressure is applied to the hairbrush bristles while brushing, the flexible base moves upwardly, thereby pressurizing the absorbent filler unit (if the absorbent filler unit is made from sufficiently spongy and/or springy material) and helps to move the liquid from the absorbent filler unit down to the absorbent feed rods located in the bores of the hairbrush bristles.

The following features are combined in one device in the present invention to accomplish convenient and even dispersion of water-based solutions and other thin and non-viscous liquids over the user's scalp and/or through the user's hair during routine hair combing or brushing:

(a) The device will have at least two and preferably several rows of the hairbrush bristles preferably mounted to a flexible base;

(b) The device will have a liquid reservoir at least partially filled with at least one absorbent filler unit;

(c) At least one bore will be formed through at least some of the hairbrush bristles, and at least one absorbent feed rod will be placed into each bore;

(d) Liquid outlets (viz., nozzles) will be mounted:
at distal ends of the hairbrush bristles to accomplish even dispersion of the liquid over the user's scalp, and/or
at side walls of the hairbrush bristles to accomplish even dispersion of the liquid through the user's hair;

(e) The nozzles located at the distal ends of the hairbrush bristles preferably will have a roller ball liquid distribution mechanism, or the absorbent feed rods located in the bristle bores will extend outwardly beyond distal ends of the bristle bores to be able to contact the user's scalp during brushing; and (f) The absorbent filler unit(s) and the absorbent feed rods will be used to transport the liquid from the liquid reservoir to the nozzles located at the distal ends of the hairbrush bristles or to the side nozzles located at the sidewalls of the hairbrush bristles, and to prevent a natural outflow of the liquid through the roller ball nozzles (viz., the direct-flow phenomenon).

Figure 7:
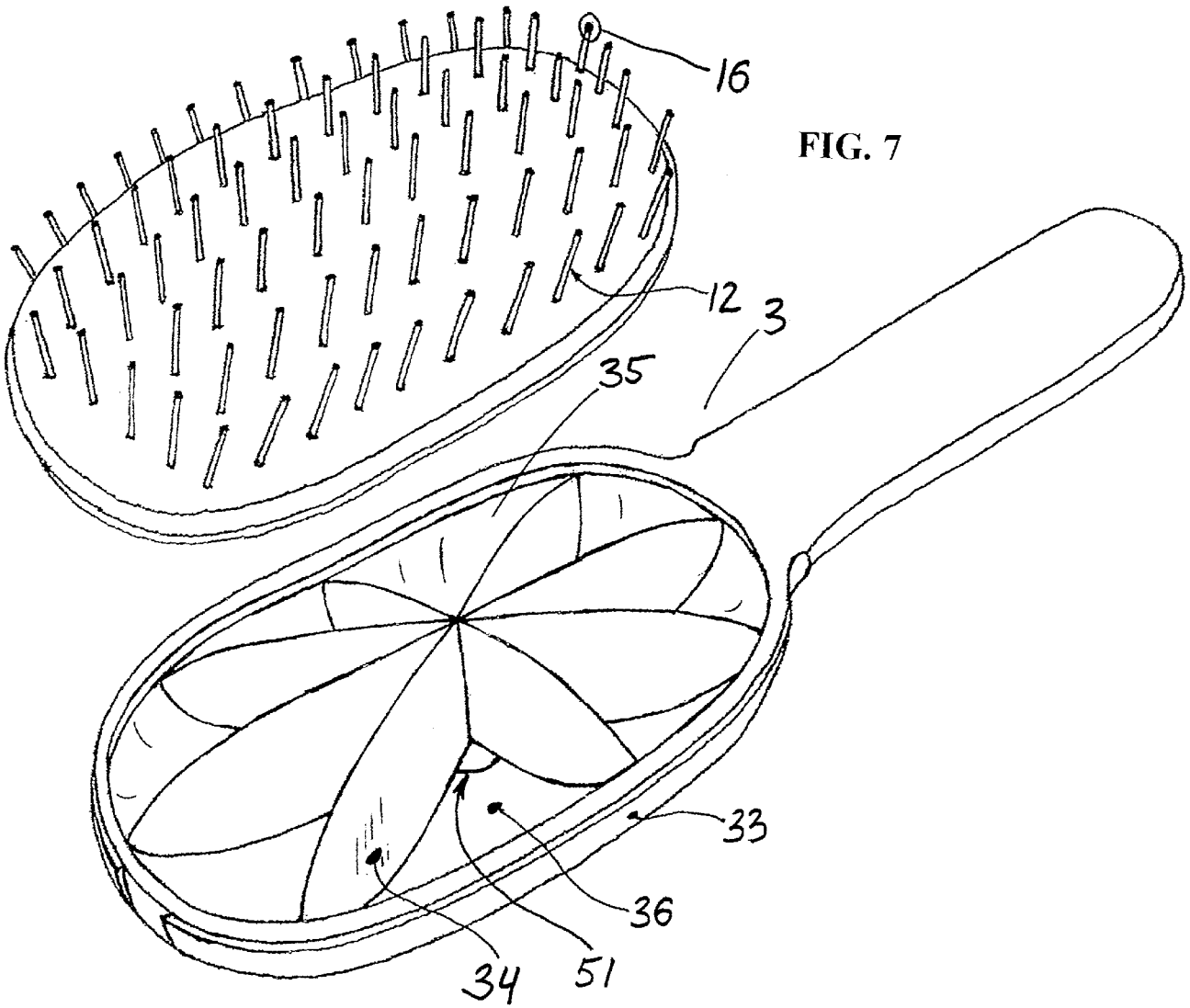
FIG. 7 is an exploded perspective view of a third embodiment of the hairbrush in accordance with the invention with a bristle frame removed to show a divider for an absorbent filler unit.
Figure 8:
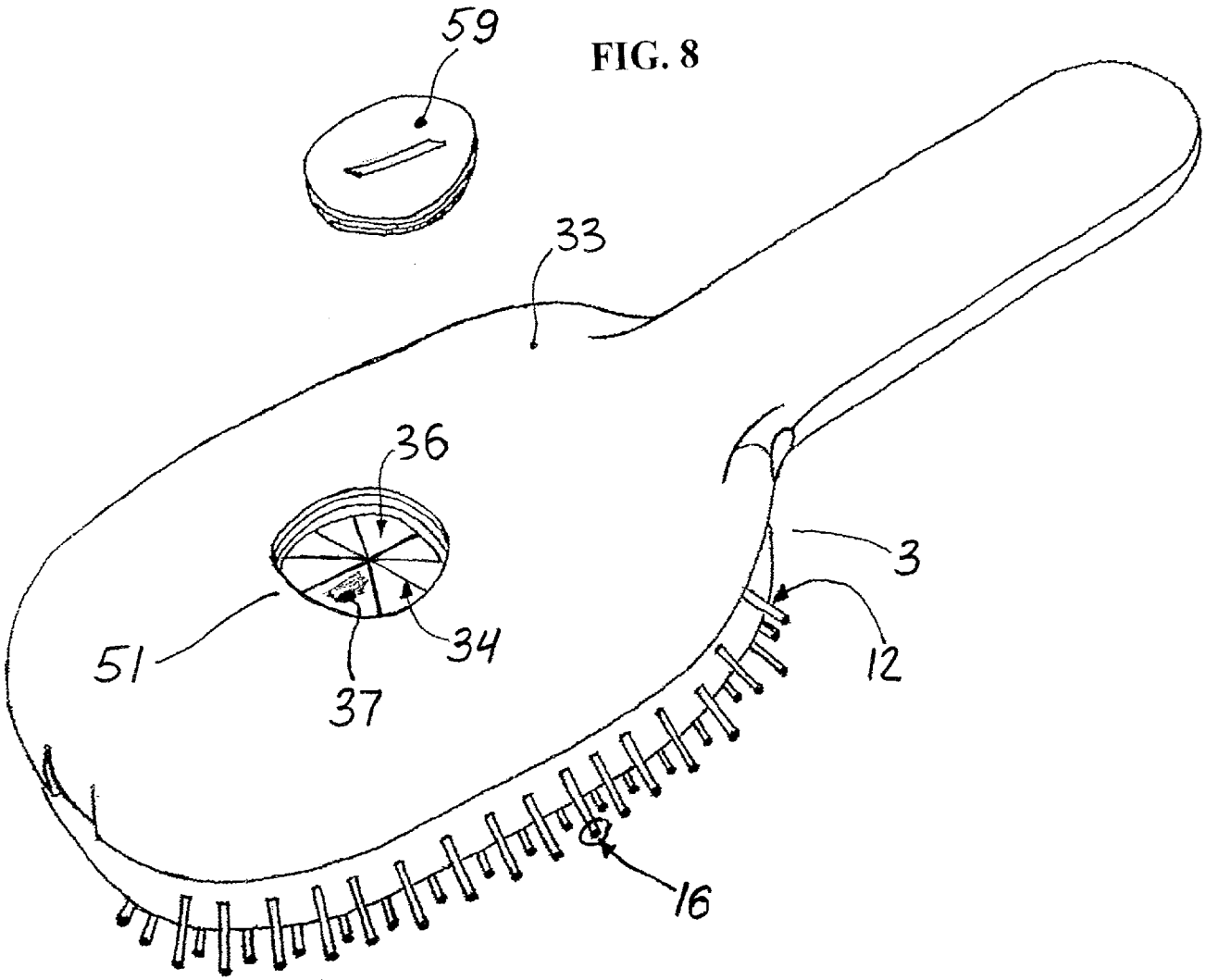
FIG. 8 is a perspective view of the hairbrush of FIG. 7 with a filler cap removed from a filler inlet to show the absorbent filler divider and the absorbent filler unit.

Three different embodiments of the hairbrush of the invention are presented. A first embodiment (FIGS. 1–5) is shown in general as 1. A second embodiment (FIG. 6) is shown in general as 2. A third embodiment (FIGS. 7–8) is shown in general as 3.

Figure 4:
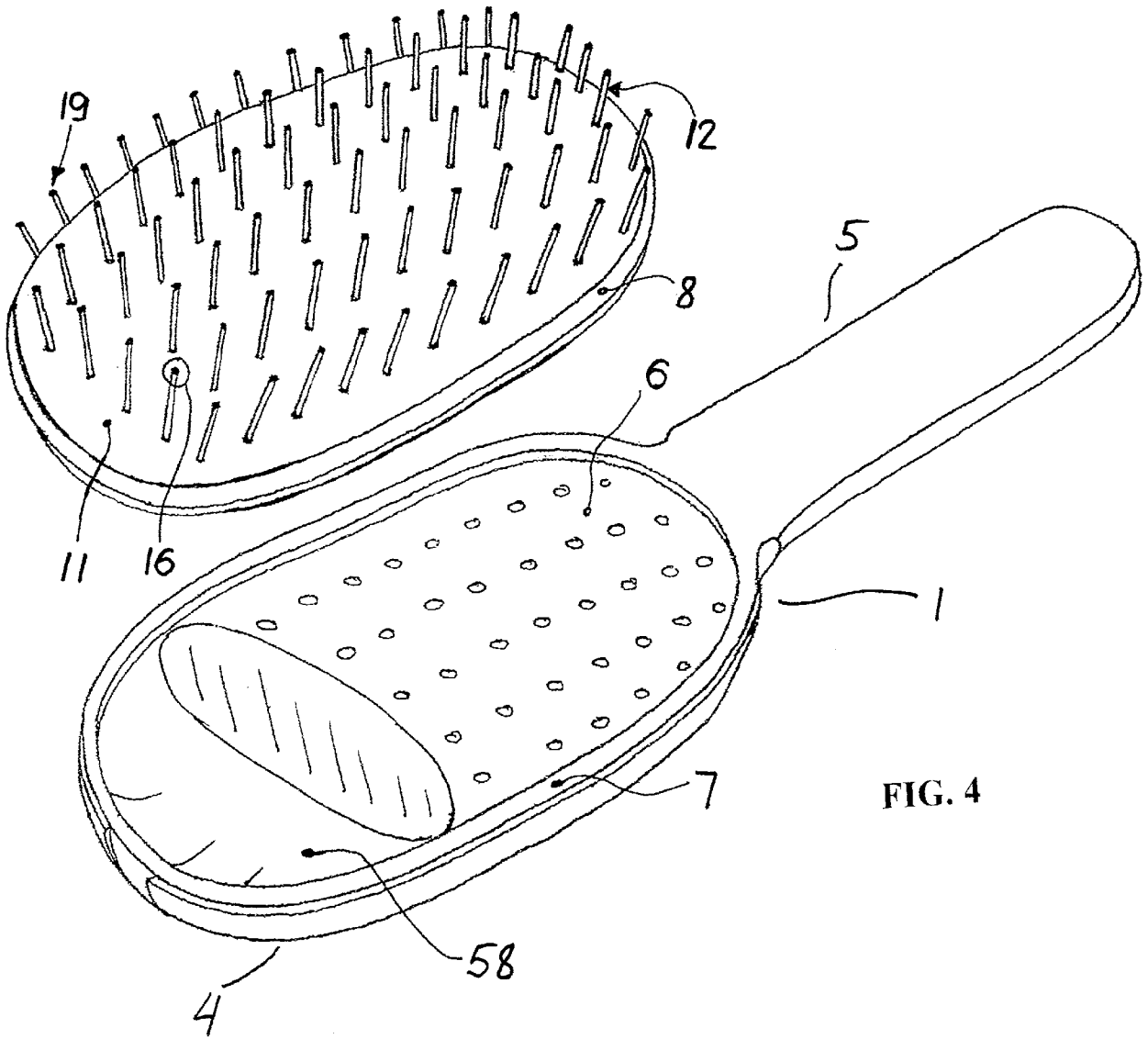
FIG. 4 is an exploded perspective view of the hairbrush of FIG. 1 with a bristle frame removed to show a partially exposed absorbent filler unit.
Figure 5:
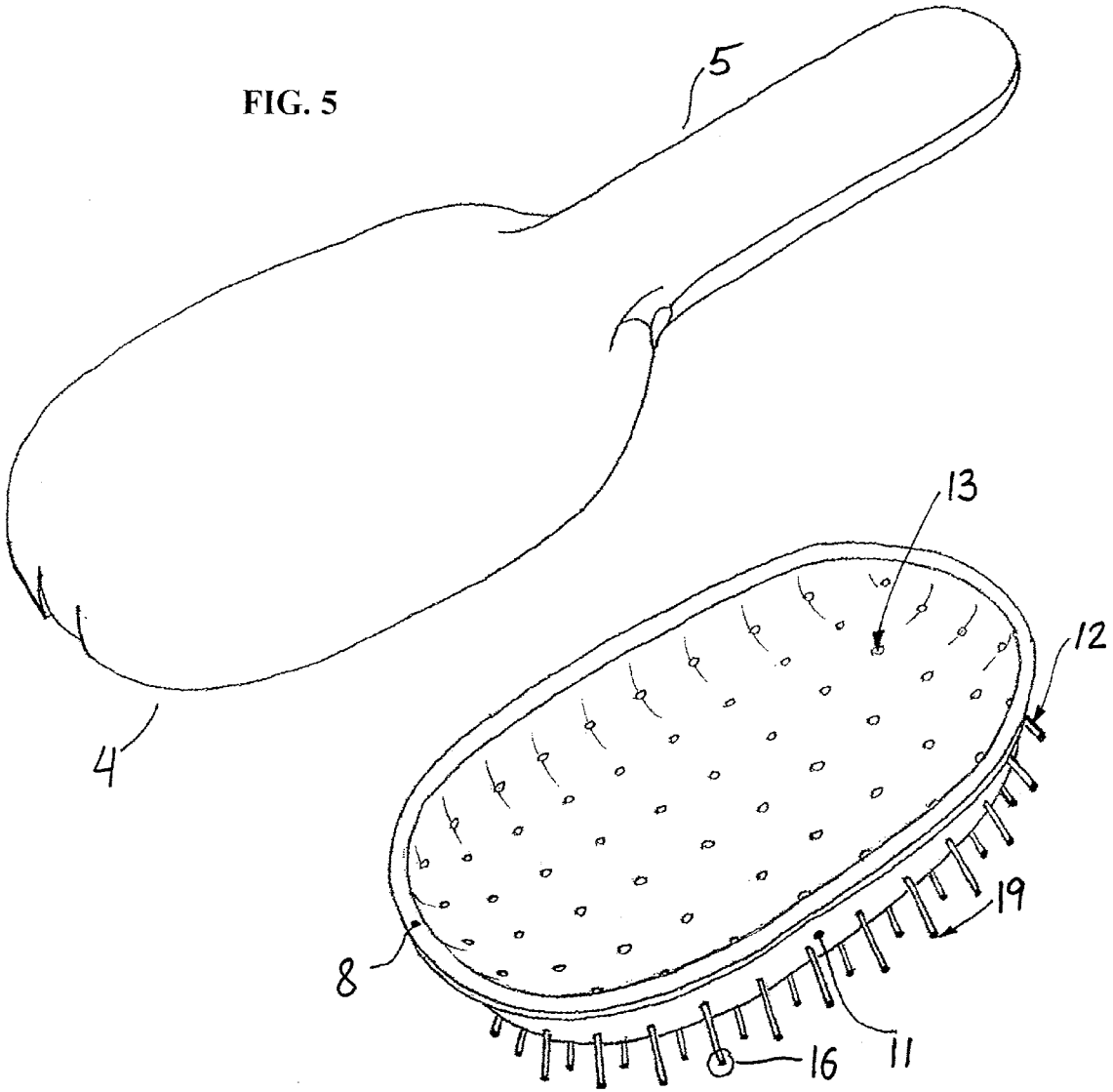
FIG. 5 is an exploded perspective view of the hairbrush of FIG. 1 with the bristle frame removed to show bores of the hairbrush bristles.
Figure 10:
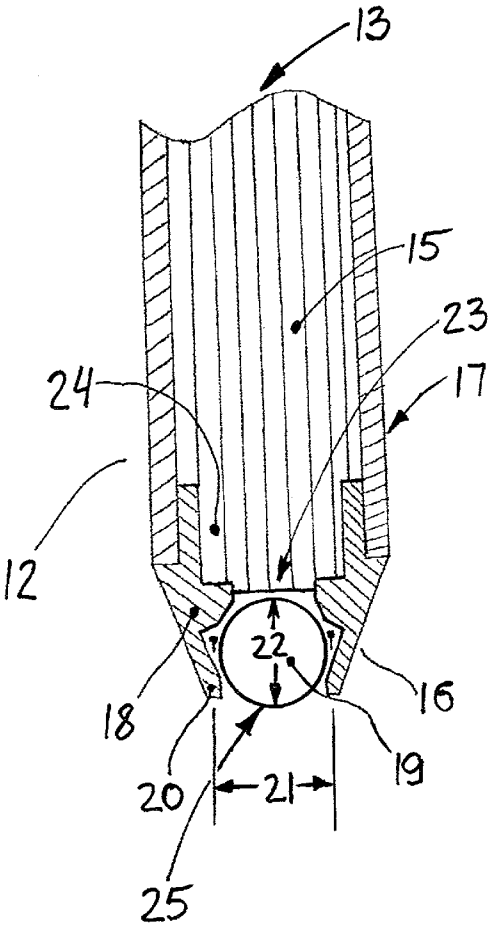
FIG. 10 is a cross-sectional view of a distal end of the hairbrush bristle in accordance with the invention showing a roller ball nozzle and a distal end of the absorbent feed rod.
Figure 9:
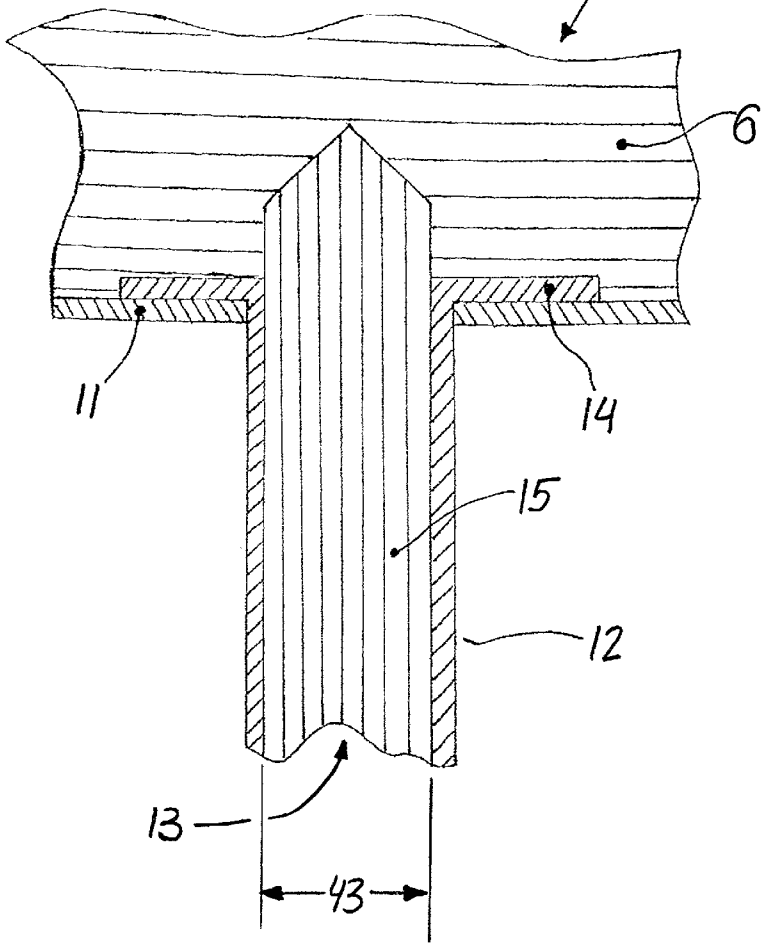
FIG. 9 is a cross-sectional view of a proximal end of the hairbrush bristle in accordance with the invention showing a connection between the absorbent filler unit and an absorbent feed rod.

Referring to the first embodiment (FIGS. 1–5), a hairbrush 1 has a body 4, a handle 5 and a bristle lid 26. The body 4 has a chamber 58 (FIG. 4), an absorbent filler unit 6, a hairbrush frame 7 and a bristle frame 8 (FIGS. 4–5). The bristle lid 26 has a catch clip 9 and two holders 10 which engage with the hairbrush body 4 near the handle 5 to permit detachable engagement of the bristle lid 6 with the body 4 of the hairbrush 1. The bristle frame 8 has a flexible base 11 with a plurality of bristles 12. All of the above hairbrush parts are preferably made from plastic, but can also be made from other known materials. The flexible base 11 is preferably made from a flexible material, such as rubber or plastic. The absorbent filler unit 6 is placed into the chamber 58 and covered by the bristle frame 8. The bristle frame 8 is preferably hermetically attached (e.g. by adhesives, welding, etc.) to the hairbrush frame 7. The plurality of the bristles 12 extend outwardly from the flexible base 11 held in the bristle frame 8. The flexible base 11 is preferably hermetically attached to the bristle frame 8 (e.g. by adhesives, welding, etc.). Each bristle 12 (FIGS. 9–10) has a bore 13, a bristle ring 14, an absorbent feed rood 15 and a nozzle 16. Each bristle 12 is preferably hermetically attached (e.g. by adhesives, welding, etc.) to the flexible base 11 by inserting the bristle ring 14 into the flexible base 1 1. The nozzle 16 is mounted at a distal end 17 of the bristle 12. The bore 13 is fully filled by the absorbent feed rod 15 and the absorbent feed rod 15 extends into the hairbrush body 4 and into the absorbent filler unit 6 and contacts the absorbent filler unit 6. The absorbent filler unit 6 can be formed from a mass or bundles of fibers with a preferable porosity of about 60%, although other porosities will also function. The absorbent filler unit 6 can also be formed from plastic or other known materials. The absorbent filler unit 6 is preferably made from a sufficiently spongy and/or springy material. The size of the absorbent filler unit 6 may preferably be between 80 and 120 cm;, so the total amount of the liquid which can be retained by the absorbent filler unit 6 will be approximately between 48 and 72 ml, however other sizes can be provided as well. The absorbent feed rod 15 can be formed from a bundle of resin-bonded fibers, however other known material can be used as well. A diameter 43 of the absorbent feed rod 15 may preferably be between 1 and 2.5 mm, however other sizes can be provided as well.

Referring back to FIG. 10, the nozzle 16 is mounted at the distal end 17 of the bristle 12 and comprises a roller ball seat 18 and a roller ball 19. The roller ball seat 18 has a rim structure 20 to retain the roller ball 19 within the roller ball seat 18. The roller ball 19 and the roller ball seat 18 can be made from stainless steel or other known materials. An internal diameter 21 of the roller ball seat 18 is preferably 0.075–0.15 mm larger than a diameter 22 of the roller ball 19, however other size difference can be provided as well. The diameter 22 of the roller ball 19 is preferably between 1.5–2.5 mm, however other sizes can be provided as well. An axial hole 23 is formed through the roller ball seat 18, and a distal end 24 of the absorbent feed rod 15 extends inwardly into the axial hole 23 and contacts the roller ball 19 for supplying the liquid to a surface 25 of the roller ball 19. The absorbent feed rod 15 interconnects the absorbent filler unit 6 and the roller ball 19. The hairbrush 1 can come pre-filled with a liquid (e.g. a water-based medicated solution). The liquid from the absorbent filler unit 6 is supplied to the roller ball 19 by means of the liquid passing through the absorbent feed rod 15 to feed the surface 25 of each roller ball 19. Each roller ball 19 is mounted within the roller ball seat 18 for rotation movement to transfer the liquid from the distal end 24 of the absorbent feed rod 15 to the user's scalp upon rotation contact of the roller ball 19 with the user's scalp. Since the bristles 12 are connected to the flexible base 11, when the user brushes his or her hair, the flexible base 11 moves upwardly, thereby pressurizing the absorbent filler unit 6 and helps to move the liquid from the absorbent filler unit 6 down to the absorbent feed rods 15. The bristle lid 26 (FIGS. 1–2) is provided to keep the hairbrush bristles 12 enclosed when the hairbrush 1 is not in use and helps prevent the roller balls 19 from drying out. The bristle lid 26 is conveniently removably mounted to the hairbrush body 4 by the catch clip 9 and two holders 10.

Figure 6A:
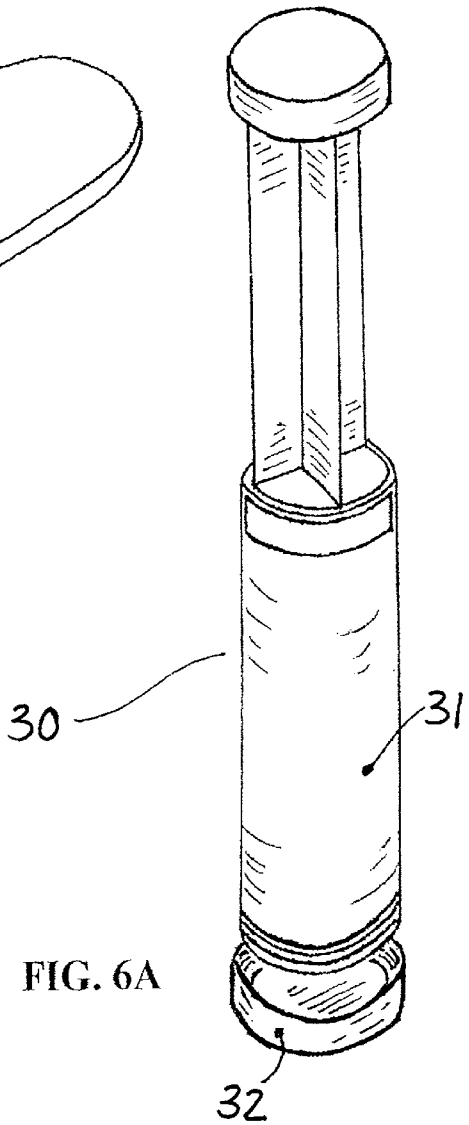
FIG. 6*a* is a perspective view of an optional liquid refilling unit.
Figure 6:
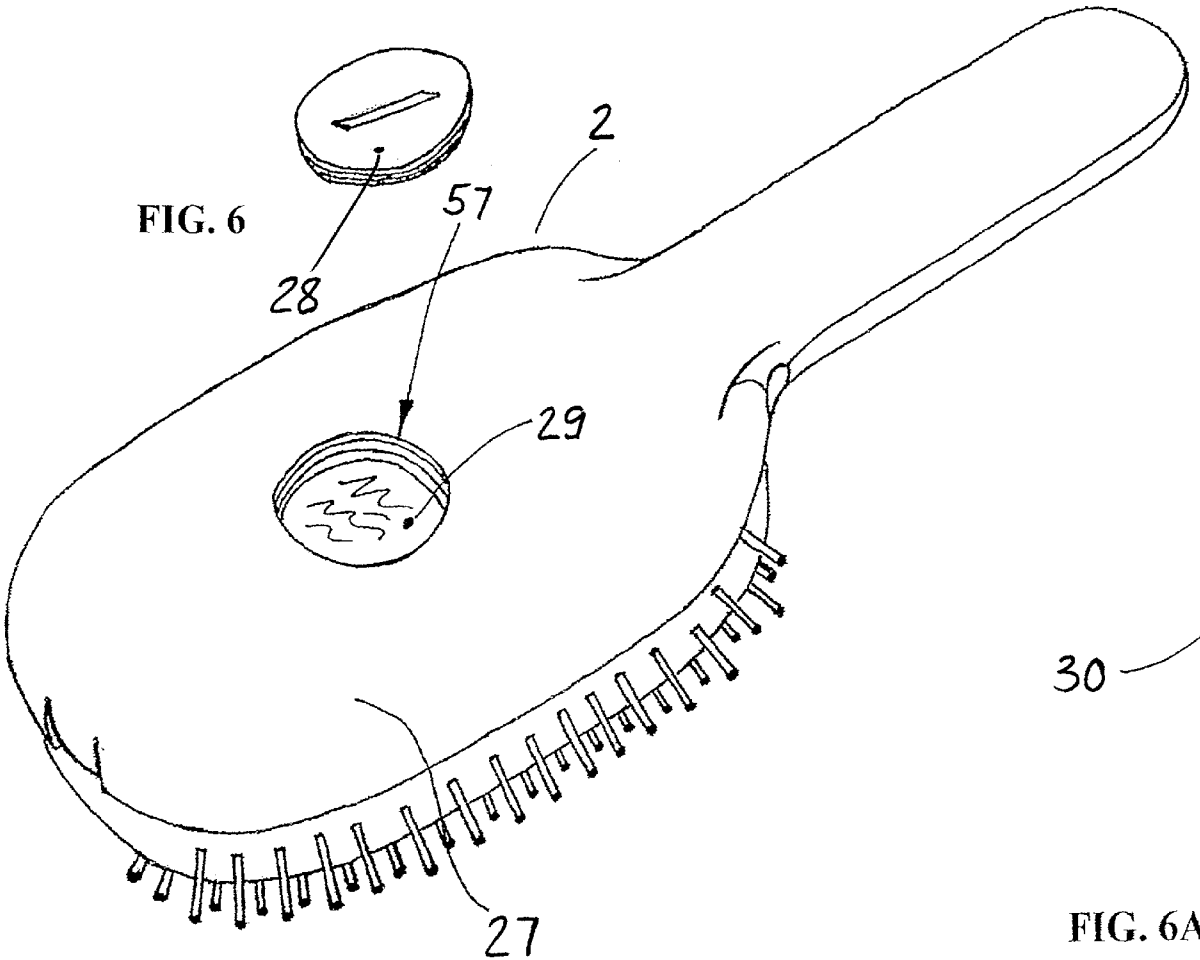
FIG. 6 is a perspective view of a second embodiment of the hairbrush in accordance with the invention. A filler cap is removed from a filler inlet and an absorbent filler unit is shown.

Referring to FIG. 6, the second embodiment of the hairbrush 2 is similar to the first embodiment 1 (FIGS. 1–5), except that the hairbrush body 27 has a filler inlet 57 and a filler cap 28, so the user can refill the absorbent filler unit 29 with or without an optional liquid refilling unit 30 (FIG. 6*a*). The liquid refilling unit 30 has a syringe construction and can hold a predetermine volume of the liquid depending on the particular design of the hairbrush 2 and the liquid capacity of the absorbent filler unit 29. The liquid refilling unit 30 is preferably made from a plastic material and has a body 31 and a cap 32. The liquid refilling unit 30 can be pre-filled with the liquid.

The third embodiment of the hairbrush 3 (FIGS. 7–8) is similar to the second embodiment 2 (FIG. 6), except that a hairbrush body 33 has an absorbent filler divider 34 which separates a chamber 35 of the hairbrush body 33 into multiple (e.g. eight) sections 36. The absorbent filler divider 34 is preferably made from the same material as a hairbrush body 33. Absorbent filler units 37 are placed into each section 36, and when a filler inlet 51 is closed by a filler cap 59, the above sections 36 are preferably hermetically isolated from one another. A purpose of the absorbent filler divider 34 is to keep the hairbrush 3 in an overall workable condition, even if some of nozzles 16 and/or bristles 12 leak and the liquid starts to drain or vaporize from the absorbent filler units 37.

Figure 16:
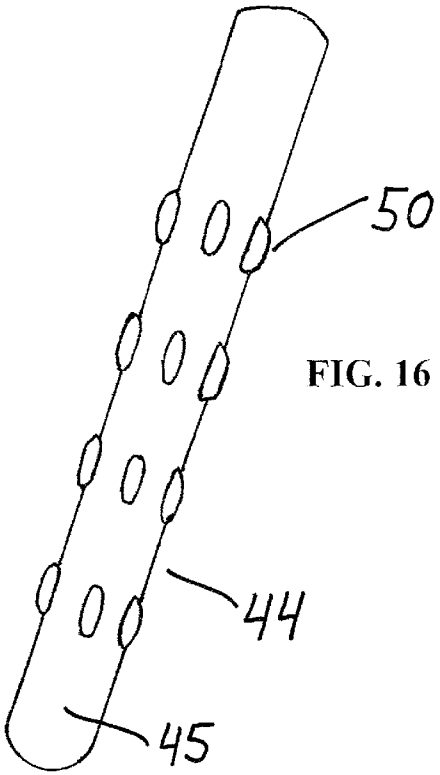
FIG. 16 is a perspective view of the hairbrush bristle of FIG. 15.
Figure 15:
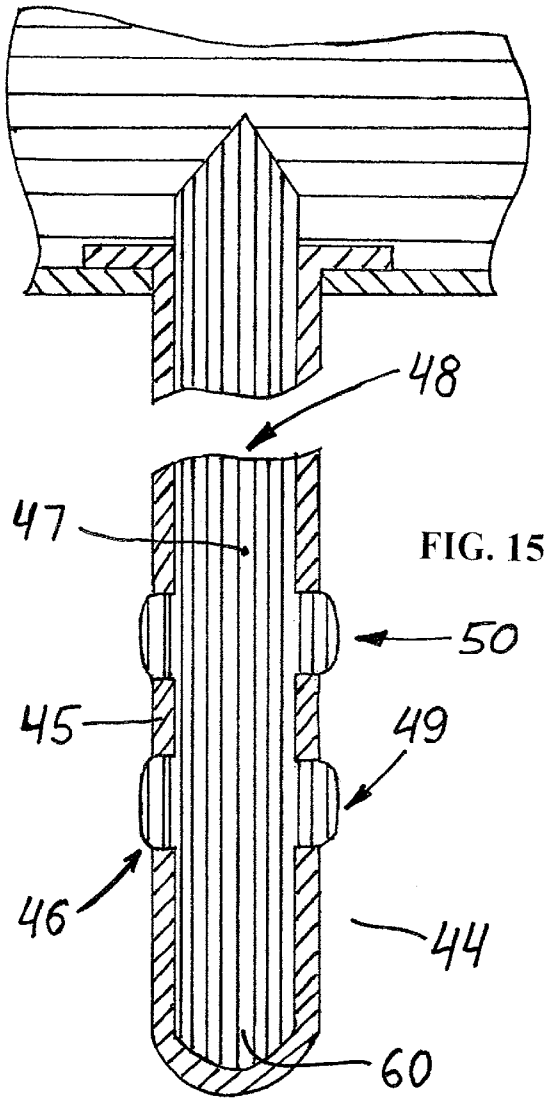
FIG. 15 is a cross-sectional view of a hairbrush bristle in accordance with the invention showing the side nozzles.

Referring to FIGS. 15 and 16, an alternative type of hairbrush bristle 44 can be provided for all three embodiments of the hairbrush 1, 2 and 3 of the invention, wherein a side wall 45 of a bristle 44 has a plurality of openings 46, and wherein at least one absorbent feed rod 47 is placed into a bore 48 of the bristle 44, and wherein portions 49 of the absorbent feed rod 47 extend outwardly beyond openings 47 to form side nozzles 50. The portions 49 of the absorbent feed rod 47 can contact the user's hair during brushing for dispersing the liquid from sides of the bristles. A distal end 60 of the bore 48 of the bristle 44 is closed, therefore liquid from the side nozzles 50 will generally disperse only through the user's hair, and only thereafter can contact the scalp. This type of bristle's construction can be very useful for users who wish to evenly disperse the liquid (e.g. styling solution) only through the hair during brushing.

Figure 13:
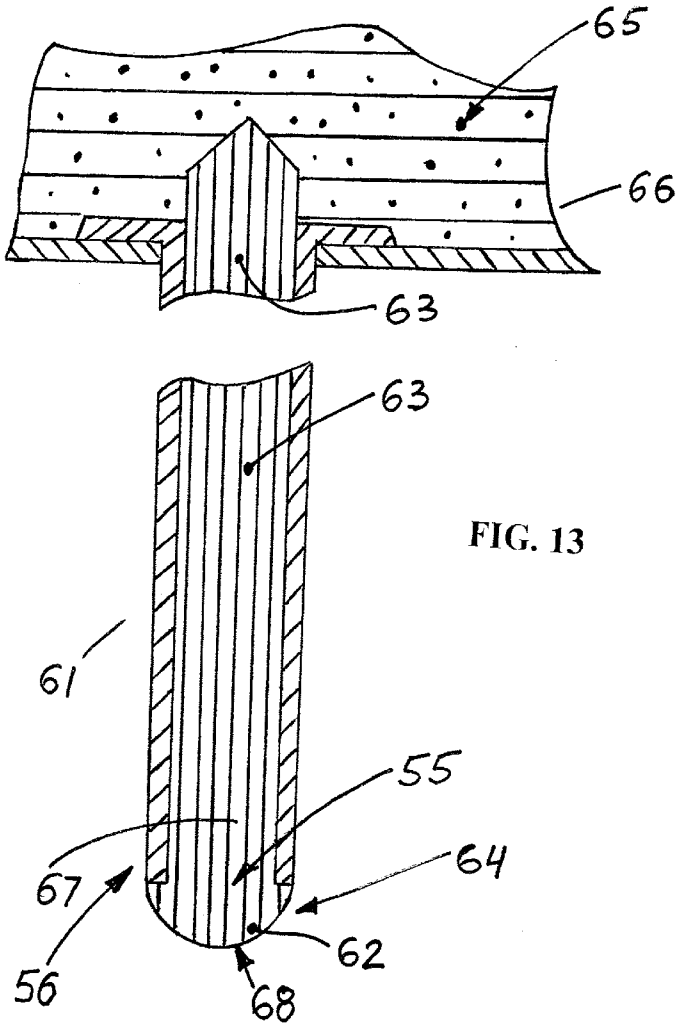
FIG. 13 is a cross-sectional view of a hairbrush bristle in accordance with the invention showing a nozzle, wherein a portion of an absorbent feed rod extends outwardly beyond a distal end thereof.

Referring to FIG. 13, a second alternative type of hairbrush bristle can be provided for all three embodiments of the hairbrush 1, 2 and 3 of the invention, wherein a hairbrush bristle 61 has a distal opening 55 at a distal end 56, and wherein a portion 62 of an absorbent feed rod 63 extends outwardly beyond the distal opening 55 to form a nozzle 64 available for contact with the user's scalp during brushing. Liquid 65 from an absorbent filler unit 66 is supplied to a distal end 67 of the absorbent feed rod 63, by means of the liquid 65 passing through the absorbent feed rod 63 to feed a surface 68 of the distal end 67 of the absorbent feed rod 63. The liquid 65 disperses from the distal end 67 of the absorbent feed rod 63 over the user's scalp upon contact of the distal end 67 of the absorbent feed rod 63 with the scalp during brushing. This type of nozzle's design construction has a shortcoming compared to the roller ball nozzle's construction, because the liquid from the absorbent feed rods can disperse through the user's hair when the distal ends of the absorbent feed rods contact the hair, and can therefore make the hair uncomfortably wet. Notwithstanding this possible shortcoming, the above describe type of nozzle's construction may provide a softer feeling brush for users with a sensitive scalp.

Figure 14:
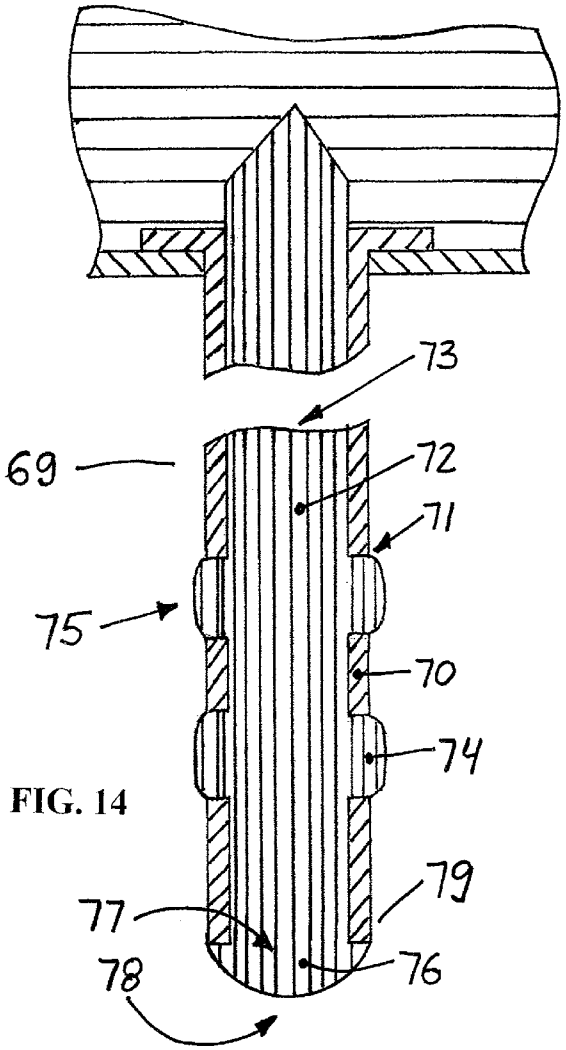
FIG. 14 is a cross-sectional view of a hairbrush bristle in accordance with the invention showing a hairbrush bristle having side nozzles and a distal nozzle, wherein the absorbent feed rod extends outwardly beyond the distal end of the bristle.

Referring to FIG. 14, a third alternative type of hairbrush bristle 69 can be provided for all three embodiments of the hairbrush 1, 2 and 3 of the invention, wherein a side wall 70 of the bristle 69 has a plurality of openings 71, and wherein at least one absorbent feed rod 72 is placed into a bore 73 of the bristle 69, and wherein portions 74 of the absorbent feed rod 72 extend outwardly beyond the openings 71 to form side nozzles 75, and wherein a distal end 76 of the absorbent feed rod 72 extends outwardly beyond a distal opening 77 to form a nozzle 78 at a distal end 79 of the bristle 69.

Figure 12:
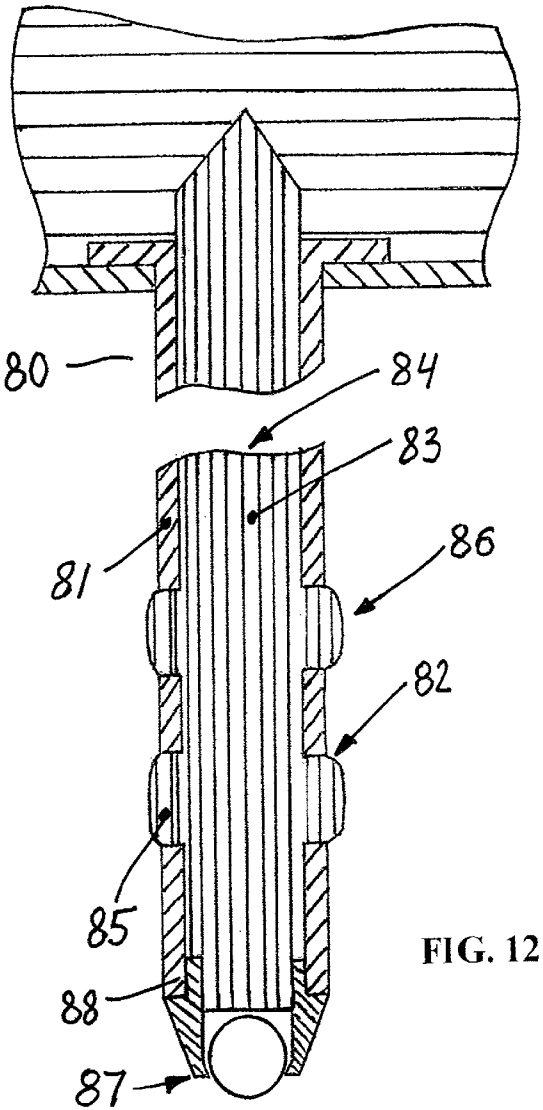
FIG. 12 is a cross-sectional view of a hairbrush bristle in accordance with the invention showing a hairbrush bristle having a roller ball nozzle and side nozzles.

Referring to FIG. 12, a fourth alternative type of hairbrush bristle 80 can be provided for all three embodiments of the hairbrush 1, 2 and 3 of the invention, wherein a side wall 81 of a bristle 80 has a plurality of openings 82, and wherein at least one absorbent feed rod 83 is placed into a bore 84 of the bristle 80, and wherein portions 85 of the absorbent feed rod 83 extend outwardly beyond the openings 82 to form side nozzles 86, and wherein a roller ball nozzle 87 is located at a distal end 88 of the bristle 80.

The third and the fourth above described bristle's designs (FIGS. 14 and 12), wherein the nozzles located at the distal end of the hairbrush bristle and at the sidewall of the bristle will allow the user to evenly disperse the liquid through the hair as well as over the scalp.

Referring back to the third embodiment 3 (FIGS. 7–8), the absorbent filler divider 34 separates the chamber 35 (viz., the absorbent filler unit 37) of the hairbrush 3 into eight hermetically isolated sections 36. This allows the different sections 36 to be filled with different liquids. Moreover, depending on what liquid reservoir (viz., absorbent filler unit) is in contact with which type of bristle, different bristles will be able to disperse different liquids over the user's scalp or through the hair during brushing. Thus, it is possible to provide a liquid reservoir hair device capable of dispersing at the same time one liquid (e.g. a medicated solution) only over the user's scalp (e.g. from the roller ball nozzles mounted at the ends of the hairbrush bristles) and another liquid (e.g. a styling solution) evenly through the user's hair (from the side nozzles located at the sides of the hairbrush bristles).

Figure 11:
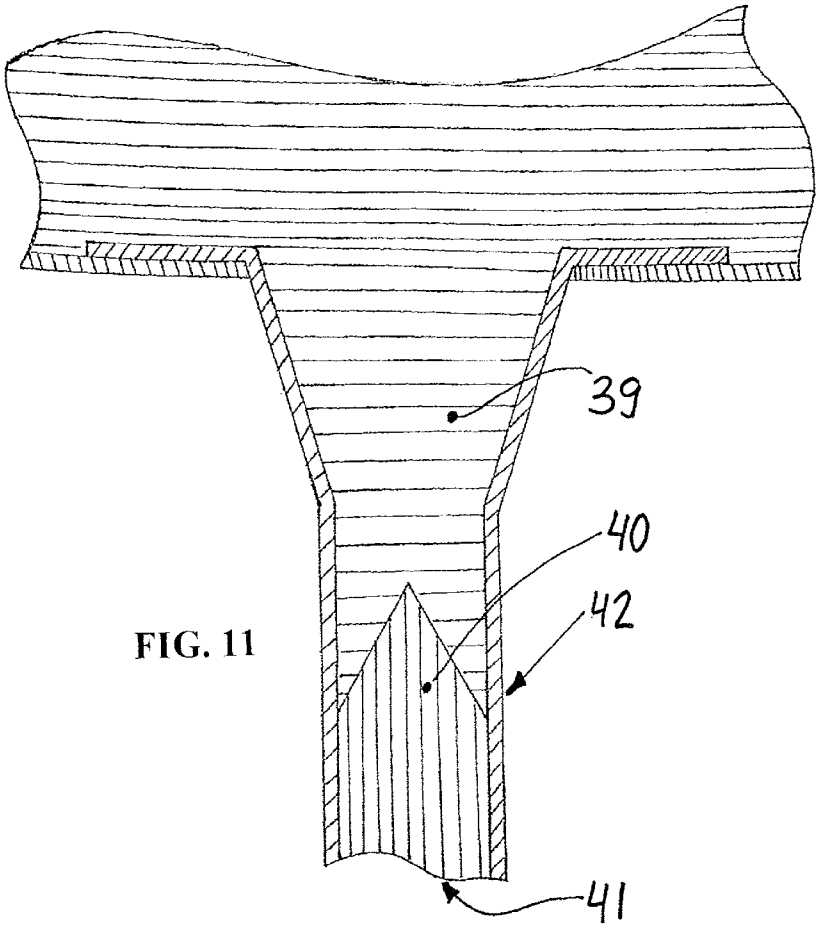
FIG. 11 is a cross-sectional view of a proximal end of a hairbrush bristle in accordance with the invention showing a connection between an absorbent filler unit and an absorbent feed rod, wherein the absorbent filler unit partially extends into the bristle's bore.

Referring back to all three embodiments of the present invention, an alternative type of connection between absorbent filler unit(s) and absorbent feed rods can be provided for all three embodiments of the hairbrush 1, 2 and 3 of the invention, wherein the absorbent filler unit partially extends into the bristle's bores. The above connection is shown in FIG. 11, where an absorbent filler unit 39 partially extends into a bore 41 of a bristle 42 and contacts an absorbent feed rod 40.

Figure 17:
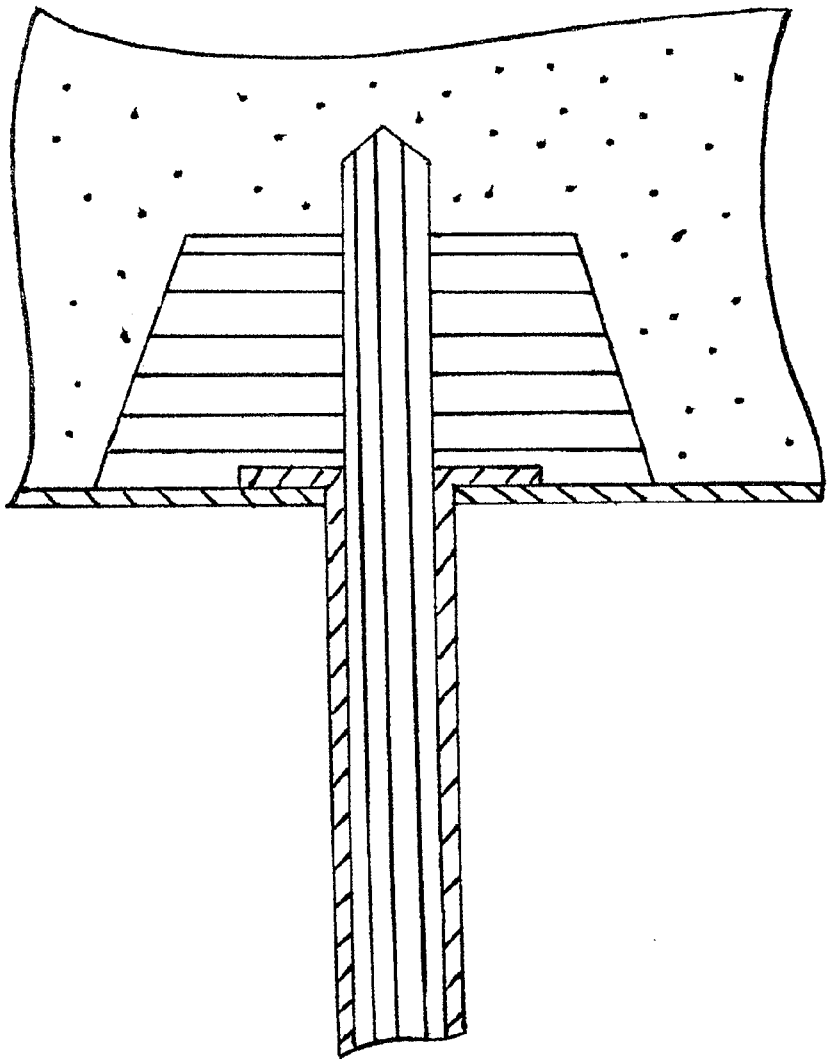
FIG. 17 is a cross-sectional view of a proximal end of a hairbrush bristle in accordance with the invention showing an alternative type of an absorbent filler unit.

Referring to FIG. 17, an alternative type of an absorbent filler unit 38 can be provided for all three embodiments of the hairbrush 1, 2 and 3 of the invention, wherein each absorbent feed rod 52 of a bristle 53 extends inwardly into and contacts a separate absorbent filler unit 38, and can also extend beyond the separate absorbent filler unit 38 into liquid reservoir 54. Liquid 89 from the liquid reservoir 54 can thus travel through the absorbent filler unit 38 down to the absorbent feed rod 52. Each absorbent filler unit 38 is preferably formed from a high-porosity plastic material, but can also be formed from other known materials. Multiple absorbent filler units 38 retain the liquid 89 from the liquid reservoir 54 and keep the hairbrush in an overall workable condition, even when the liquid 89 is not in contact with the absorbent feed rods 52 and/or the absorbent filler units 38.

The aforementioned three embodiments of the hairbrush of the present invention are relatively inexpensive to produce and can provide a convenient and efficient hairbrush device that is capable of evenly dispersing low viscosity water-based solutions and other thin and non-viscous liquids over the user's scalp and/or through the user's hair during routine hair brushing.

What is claimed is:

1. A liquid-reservoir hairbrush adapted for dispersing water-based solutions and other thin and non-viscous liquids over a user's scalp during hair brushing, comprising:

(a) a hairbrush body having a chamber;

(b) at least one absorbent filler unit adapted to retain liquid and placed into the chamber; and (c) a plurality of hairbrush bristles, each having a proximal end and a distal end, the hairbrush bristles being mounted in a vicinity of their proximal ends to the hairbrush body, wherein at least some of the hairbrush bristles comprise;

an elongate body with a sidewall and with at least one bore formed therethrough, at least one absorbent feed rod, each absorbent feed rod having a proximal end and a distal end, and placed into the at least one bore, a distal opening located at the distal end of the hairbrush bristles, wherein the distal end of the absorbent feed rod extends outwardly beyond the distal opening to form a nozzle available for contact with the user's scalp during brushing, and wherein the proximal end of the absorbent feed rod contacts the at least one absorbent filler unit wherein the at least one abosrbent filler unit partially extends into the bores of the hairbrush bristles and contacts the abosrbent feed rods located therein.

2. The hairbrush of claim 1, wherein the absorbent filler unit is pre-filled with the liquid.

3. The hairbrush of claim 1, further comprising a flexible base mounted to the hairbrush body, wherein the hairbrush bristles are mounted to the flexible base.

4. The hairbrush of claim 1, further comprising a bristle lid to keep the hairbrush bristles enclosed when the hairbrush is not in use and to help prevent the nozzle from drying out.

5. The hairbrush of claim 1, wherein the chamber is divided into at least two separate sections, and wherein these sections are preferably hermetically isolated from one another, and wherein at least one of the absorbent filler units is placed into each section.

6. The hairbrush of claim 1, wherein the hairbrush body has a filler inlet to permit the user to refill the absorbent filler unit with liquid.

7. The hairbrush of claim 6, further comprising a liquid refilling unit that is adapted to place liquid into the absorbent filler unit when the filler inlet is opened.

8. The hairbrush of claim 7, wherein the liquid refilling unit is pre-filled with the liquid and is adapted to engage with the hairbrush body when the filler inlet is opened.

9. The hairbrush of claim 1, wherein the absorbent feed rods of the hairbrush bristles extend into the hairbrush body and into the at least one absorbent filler unit and contact the absorbent filler unit.

* * * * *